US007792309B2

(12) United States Patent
Ng

(10) Patent No.: US 7,792,309 B2
(45) Date of Patent: Sep. 7, 2010

(54) HEARING APPARATUS WITH STATUS SIGNAL FACILITY AND CORRESPONDING METHOD

(75) Inventor: Hui Yong Ng, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1051 days.

(21) Appl. No.: 11/507,842

(22) Filed: Aug. 22, 2006

(65) Prior Publication Data

US 2007/0121960 A1 May 31, 2007

(30) Foreign Application Priority Data

Aug. 31, 2005 (DE) ..... 10 2005 041 353

(51) Int. Cl.
*H04R 29/00* (2006.01)
*H04R 25/00* (2006.01)

(52) U.S. Cl. ..... 381/58; 381/312

(58) Field of Classification Search ..... 381/58–60, 381/312, 314, 315; 600/559
See application file for complete search history.

(56) References Cited

U.S. PATENT DOCUMENTS 6,115,478 A * 9/2000 Schneider ..... 381/314
6,554,762 B2 4/2003 Leysieffer

FOREIGN PATENT DOCUMENTS

DE 100 41 726 C1 5/2002

* cited by examiner

*Primary Examiner*—Tuan D Nguyen

(57) ABSTRACT

Status changes in a hearing apparatus and in particular a hearing device should be able to be transmitted to an external data processing facility in a more rapid manner. For this purpose, provision is made for the hearing apparatus to comprise a sensor facility to capture a status of a component of the hearing apparatus. Furthermore, a status signal facility is integrated into the hearing apparatus, said status signal facility being connected to the sensor facility and being able to be used to automatically transmit a signal to the external data processing facility, when a change in the status occurs. The status of the hearing apparatus need thus not be continually queried, but a corresponding signal is actively sent outwards in the event of a status change. The battery service life of a hearing device can hereby be increased for instance.

11 Claims, 1 Drawing Sheet

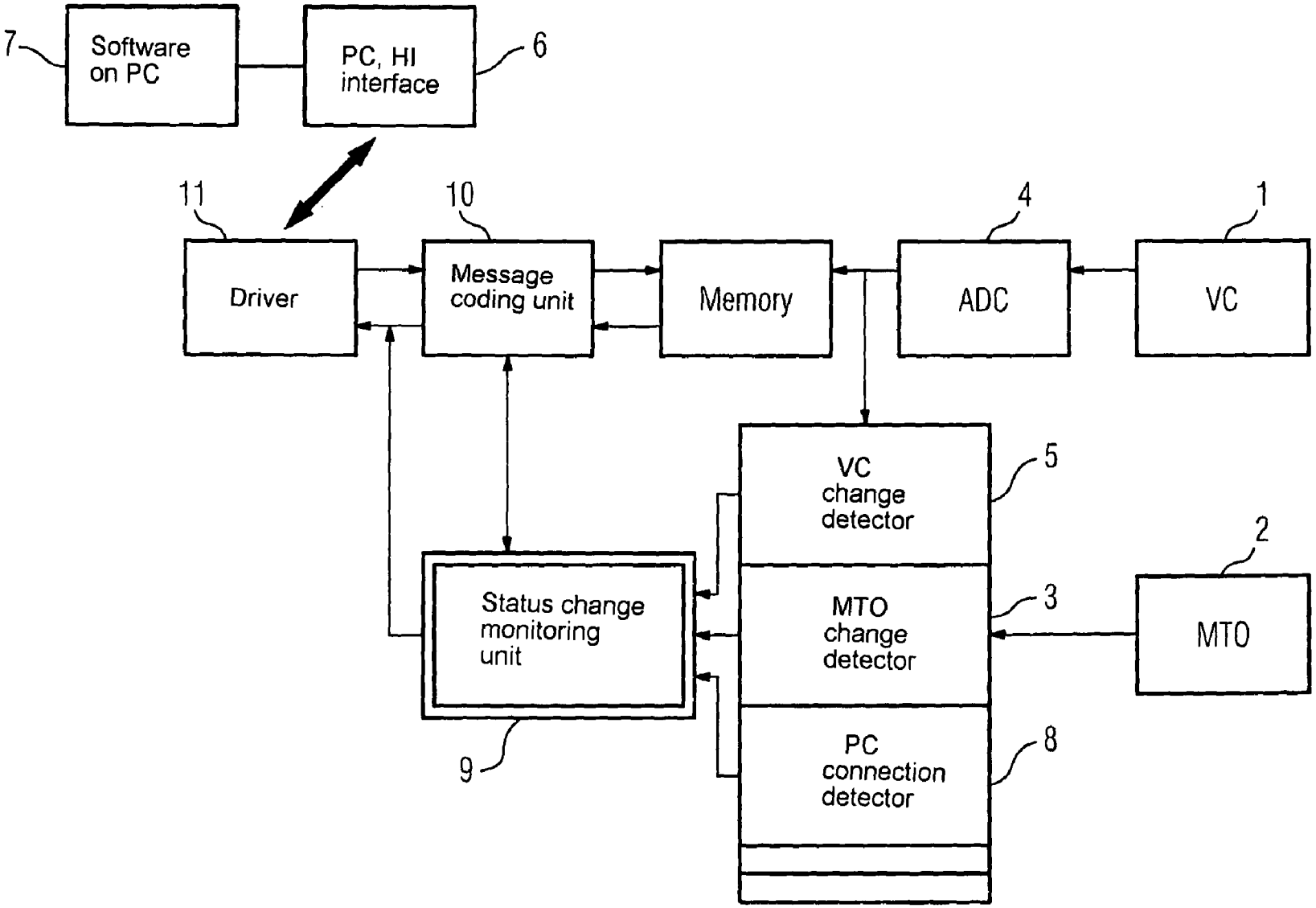
VC
1
MTO
2
ADC
4
5
3
8
VC change detector
MTO change detector
PC connection detector
Memory
Status change monitoring unit
9
Message coding unit
10
6
PC, HI interface
Driver
11
Software on PC
7

HEARING APPARATUS WITH STATUS SIGNAL FACILITY AND CORRESPONDING METHOD

CROSS REFERENCE TO RELATED APPLICATIONS

This application claims priority of German application No. 10 2005 041 353.6 filed Aug. 31, 2005, which is incorporated by reference herein in its entirety.

FIELD OF THE INVENTION

The present invention relates to a hearing apparatus, in particular a hearing device, with a connecting facility to an external data processing facility. Furthermore, the present invention relates to a method for monitoring a hearing apparatus by capturing at least one status and one component of the hearing apparatus by means of the hearing apparatus itself.

BACKGROUND OF THE INVENTION

Hearing devices but also individually adjustable headsets, headphones and suchlike are typically connected to a computer for adjustment purposes. Corresponding software then preferably allows the behavior and/or the characteristics of the hearing apparatus to be displayed in real-time. In this way, the hearing apparatus can be adjusted in a user-friendly manner.

By way of example, hearing devices have a plurality of adjustment options. These include not only the control elements on the hearing device itself, such as program switches, loudspeaker controllers and trimmers for modifying the transmission function, in particular with non-programmable hearing devices, but also the software algorithms on the ASIC of the hearing device signal processing. In addition, further adjustment options can be expected in the future.

Current solutions of virtually obtaining the status of the hearing device in real-time thus-consist in continually querying (polling) the hearing devices. The polling speed is however generally relatively low, i.e. the readout interval for recalling the status data from the hearing device is relatively long. The behavior and/or the status of the hearing device can thus only be displayed on the computer with a delay and furthermore jump effects can be observed whilst the data is updated.

In principle, it would be possible to avoid this disadvantage by increasing the polling speed. However, this is disadvantageous as regards the service life of the hearing device battery and the processor load on the hearing device.

Patent application DE 100 41 726 C 1 discloses an implantable hearing system with means to adjust the coupling quality. In this way, a telemetry facility is designed externally in order to receive operating programs from an external unit but also to transfer operating parameters between the implantable part of the system and the external unit. On the one hand, such parameters can thus be adjusted be a doctor, a hearing device acoustician or the wearer of the system him/herself, on the other hand the system can however also transmit parameters to the external unit, for instance to monitor the status of the system.

SUMMARY OF THE INVENTION

The object of the present invention is thus to obtain status information about the hearing apparatus more promptly, without essentially imposing a heavier load on the hearing device.

In accordance with the invention, this object is achieved by a hearing apparatus, in particular hearing device, having a connecting facility to an external data processing facility, a sensor facility to capture at least one status of at least one component of the hearing apparatus and a status signal facility, which is connected to the sensor facility and with which a status signal can be automatically generated, triggered by a change in the least one status, and said signal can be transmitted to the external data processing facility via the connecting facility.

Furthermore, a method for monitoring a hearing apparatus is provided in accordance with the invention, in particular a hearing device, by the hearing apparatus itself capturing at least one status of at least one component of the hearing apparatus, by the hearing apparatus capturing a change in the at least one status and by automatic generation and transmission of a status signal about the status change from the hearing apparatus to an external data processing facility, triggered by the change.

Advantageously, it is thus possible for the status data about the hearing apparatus to be directly transmitted after the status change to the external data processing facility practically without any time delay. The data about the hearing apparatus is thus available in real-time on the data processing facility. A further advantage of the principle according to the invention, whereupon the hearing apparatus itself is active for the status signal, thus consists in the status not constantly having to be queried and output, if no changes occur. Savings can hereby be made on energy and processor performance.

The at least one component of the hearing apparatus is preferably an activation unit for manually operating the hearing apparatus. In particular, the activation unit is an program switch, a loudspeaker controller or a trimmer. By way of example, the acoustician who would like to adjust the hearing apparatus immediately receives a feedback about the manual control of the hearing apparatus.

The at least one component, the status of which is monitored, can however also be the connecting facility, with which the hearing apparatus can be coupled to the external data processing facility, or be a component thereof. The operator thus immediately receives a current notification as to whether a data communication exists between the hearing apparatus and the external data processing facility.

According to a further developed embodiment, the signal about the status of the hearing apparatus also contains information about the type of hearing apparatus. The data processing facility and/or the software installed thereupon can hereby be used to adjust a number of different hearing apparatuses.

BRIEF DESCRIPTION OF THE DRAWINGS

The present invention is now described in more detail with reference to the appended drawings, which show a principle schematic diagram of the inventive hearing apparatus and/or of the inventive method.

DETAILED DESCRIPTION OF THE INVENTION

The exemplary embodiment described below in further detail represents a preferred embodiment of the present invention.

The hearing device reproduced in the FIGURE features a loudspeaker controller 1 and an MTO or program switch 2. An MTO value change detector 3 immediately records a change in the program switch 2. On the other hand, an analog digital converter 4 first converts an output value of the loudspeaker controller 1 into a digital value, before a VC value change detector 5 records it.

As the hearing device is coupled via a PC hearing device interface 6 with a PC and/or the software 7 thereof in a wireless or wired manner, the hearing device also has a PC connection detector 8. This detects whether the data link to the PC actually exists and/or was changed.

The FIGURE indicates that the hearing device has and/or can have further detectors for monitoring hearing device components. These detectors are then connected to the corresponding components of the hearing device and monitor their changes.

In a status change monitoring unit 9, all signals from the change detectors 3, 5, 8 converge. In a message coding unit 10, which can be completely or partially integrated into the status change monitoring unit 9, a status signal is generated from the data of the status change monitoring unit 9 by means of a corresponding coding. The message is then transmitted to the PC 7 via a driver 11 for wired or wireless communication. If necessary, a status change can be directly transmitted from the status change monitoring unit 9 via the driver 11 to the PC 7.

According to the idea behind the invention, the hearing device is thus equipped with a circuit which can process status changes. A communication driver, which sends a status change signal to a PC, is triggered by the circuit. In this way, the new status information is coded in a message and transmitted.

The following advantages result from the inventive design of the inventive hearing apparatus and/or the inventive monitoring method of status changes in a hearing apparatus:

The direct feedback of changes on the hearing apparatus to the data processing facility allows software to be perceived in a more user-friendly manner. Furthermore, the hearing apparatus and/or the hearing device can block further outputs to the data processing facility provided no change in the adjustments occur, in order to suppress interference noises for the user, triggered by interferences on the basis of this data communication.

The circuit additionally introduced into the hearing apparatus can detect whether the hearing device was newly connected to a PC and can trigger the PC to automatically detect the model of the hearing device and can then correspondingly update the status information and other data about the hearing device on the monitor of the PC. A further advantage finally consists, particularly with wireless data connection, as was already illustrated above, in continual querying of the data (polling) not being necessary, if the status of the hearing apparatus is not changed. Accordingly, a static signal is not sent repeatedly, so that the battery service life of the hearing apparatus can be increased.

The invention claimed is:

1. A hearing apparatus, comprising:

a connecting facility that connects the hearing apparatus to an external data processing facility;

a sensor facility that captures a status change of a component of the hearing apparatus; and a status signal facility connected to the sensor facility that automatically generates a status signal triggered by the status change and transmits the status signal to the external data processing facility via the connecting facility.

2. The hearing apparatus as claimed in claim 1, wherein the component of the hearing apparatus is an activation unit for manually controlling the hearing apparatus.

3. The hearing apparatus as claimed in claim 2, wherein the activation unit is a program switch or a loudspeaker controller.

4. The hearing apparatus as claimed in claim 1, wherein the component of the hearing apparatus is the connecting facility or a component thereof.

5. The hearing apparatus as claimed in claim 1, wherein the status signal contains information of a type of the hearing apparatus.

6. The hearing apparatus as claimed in claim 1, wherein the hearing apparatus blocks transmitting the status signal to the external data processing facility if no status changes are captured.

7. The method as claimed in claim 1, wherein the hearing apparatus is a hearing device.

8. A method for monitoring a hearing apparatus, comprising:

connecting the hearing apparatus to an external data processing facility;

capturing a status change of a component of the hearing apparatus; and automatically generating a status signal triggered by the status change and transmitting the signal to the external data processing facility.

9. The method as claimed in claim 8, wherein the status signal contains information about a type of the hearing apparatus.

10. The method as claimed in claim 8, wherein the hearing apparatus is a hearing device.

11. The method as claimed in claim 8, further comprising blocking transmitting the status signal to the external data processing facility if no status changes are captured.

* * * * *